United States Patent [19]

Thomas et al.

[11] Patent Number: 4,535,836

[45] Date of Patent: Aug. 20, 1985

[54] VERTICALLY EXTENDING HEAT EXCHANGER

[75] Inventors: Edward B. Thomas, Verona; Mark C. Peters, Pewaukee, both of Wis.

[73] Assignee: Crepaco, Inc., Lake Mills, Wis.

[21] Appl. No.: 543,080

[22] Filed: Oct. 18, 1983

[51] Int. Cl.[3] ..... F28D 11/02; F28F 5/02

[52] U.S. Cl. ..... 165/86; 165/94; 366/147

[58] Field of Search ..... 165/86, 88, 94, 95; 62/432, 433; 366/144, 147, 279

[56] References Cited

U.S. PATENT DOCUMENTS

| | | | |
|---|---|---|---|
| 2,924,952 | 2/1960 | Swenson et al. | 62/342 X |
| 3,633,664 | 1/1972 | Walsh | 165/94 |
| 3,955,617 | 5/1976 | Walsh | 165/94 |
| 4,073,339 | 2/1978 | D'Orsay | 165/94 |
| 4,162,127 | 7/1979 | Wakeman et al. | 62/343 X |
| 4,171,819 | 10/1979 | Martineau | 62/342 X |
| 4,203,461 | 5/1980 | Schwiffers | 62/342 X |
| 4,282,925 | 8/1981 | Hay et al. | 165/94 |
| 4,383,768 | 5/1983 | Kupka | 366/279 |

*Primary Examiner*—Sheldon J. Richter
*Assistant Examiner*—Randolph A. Smith
*Attorney, Agent, or Firm*—Neuman, Williams, Anderson & Olson

[57] ABSTRACT

A vertically extending heat exchanger is provided in which an elongated dasher is rotatably mounted within an upright cylindrical chamber. The exterior surface of the dasher coacts with the interior surface of the chamber to form a product flow passage. The opposite side of the chamber interior surface is in contact with a heat exchange medium. The dasher is selectively movable longitudinally of the chamber between operative and inoperative modes. When in the operative mode, the dasher is fully assembled within the chamber and is supported at opposite ends by upper and lower endwall assemblies, the latter being mounted, respectively, on the upper and lower exterior end portions of the chamber. The dasher is movable to the inoperative mode when the lower endwall assembly is disassembled from the chamber and the dasher is lowered through the lower end portion of the chamber. The upper endwall assembly includes a static seal section disposed in an encompassing non-rotating relation with an upwardly projecting axial segment of the dasher, and a dynamic seal section encompassed by said static seal section and in sealing engagement therewith. The dynamic seal section encompasses the dasher axial segment and is rotatable therewith as a unit and moves longitudinally with the dasher when the latter is moved between operative and inoperative modes. The dasher axial segment has a portion protruding upwardly from the dynamic and static seal sections and is drivingly engaged by an external drive unit only when the dasher is in the operative mode. The dasher axial segment portion automatically engages with the drive unit when the dasher moves from the inoperative mode to the operative mode.

10 Claims, 4 Drawing Figures

VERTICALLY EXTENDING HEAT EXCHANGER

BACKGROUND OF THE INVENTION

Various vertically extending heat exchangers (e.g., scraped surface heat exchangers) have been provided and utilized for many years in dairy processing plants and the like. Such heat exchangers, while possessed of many virtues, are nevertheless beset with one or more of the following serious shortcomings: (a) tall ladders, high scaffolding, or other external superstructure is needed in order to facilitate the required connecting, disconnecting, or loosening of various elevated, sometimes inaccessible, structural components to permit inspection and/or replacement, or cleaning of certain seals associated with the dasher; (b) proper alignment of the dasher within the chamber is a frustrating, time-consuming operation requiring the talents of highly skilled personnel; (c) various seals are subjected to an inordinate amount of wear requiring frequent replacement; (d) the exchanger was not capable of accommodating a wide variety of products; and (e) the exchanger was not suitable for use in aseptic processing systems.

SUMMARY OF THE INVENTION

Thus, it is an object of the invention to provide a vertical heat exchanger which effectively overcomes the aforenoted shortcomings of prior heat exchangers of this general type.

It is a further object to provide an improved vertical heat exchanger wherein servicing thereof is greatly simplified with a minimum amount of manual labor.

It is a still further object to provide an improved vertical heat exchanger which eliminates the need for tall ladders, high scaffolding, or costly superstructure and the like and special aligning equipment when the dasher is being assembled or disassembled with respect to the chamber.

Further and additional objects will appear from the description, accompanying drawings, and appended claims.

In accordance with one embodiment of the invention, a vertical heat exchanger is provided which includes an elongated dasher mounted within an upright chamber for rotation about a substantially vertical axis. An exterior portion of the dasher coacts with a cylindrical interior surface of the chamber to form a product flow passage. A heat exchange medium is in contact with the cylindrical interior surface and is separated from the product flow passage by said surface. The dasher is selectively movable longitudinally relative to the chamber between operative and inoperative modes. When in an operative mode, the dasher is fully assembled within the chamber and is supported at opposite ends by upper and lower endwall assemblies for rotation about a vertical axis. The endwall assemblies are respectively mounted on upper and lower exterior portions of the chamber. The dasher is movable to an inoperative mode when the lower endwall assembly is disassembled from the lower end portion of the chamber thereby allowing the dasher to be lowered through the chamber lower end portion. The upper endwall assembly includes a static seal section disposed in an encompassing, non-rotating relation with an upwardly projecting axial segment of the dasher, and a dynamic seal section encompassed by the static seal section and in sealing engagement therewith. The dynamic seal section encompasses the dasher axial segment and rotates therewith as a unit. The dynamic and static seal sections have complemental portions in abutting sealing engagement when the dasher is in an operative mode. The dynamic seal section moves relative to the static seal section and both move as a unit with the dasher when the latter moves longitudinally between operative and inoperative modes. The dasher axial segment has a portion thereof which protrudes upwardly from the dynamic and static seal sections and is drivingly engaged by a drive unit when the dasher is in an operative mode. The axial segment automatically moves into driving engagement with the drive unit when the dasher moves from an inoperative mode to an operative mode.

DESCRIPTION

For a more complete understanding of the invention reference is made to the drawings, wherein.

Figure 1:
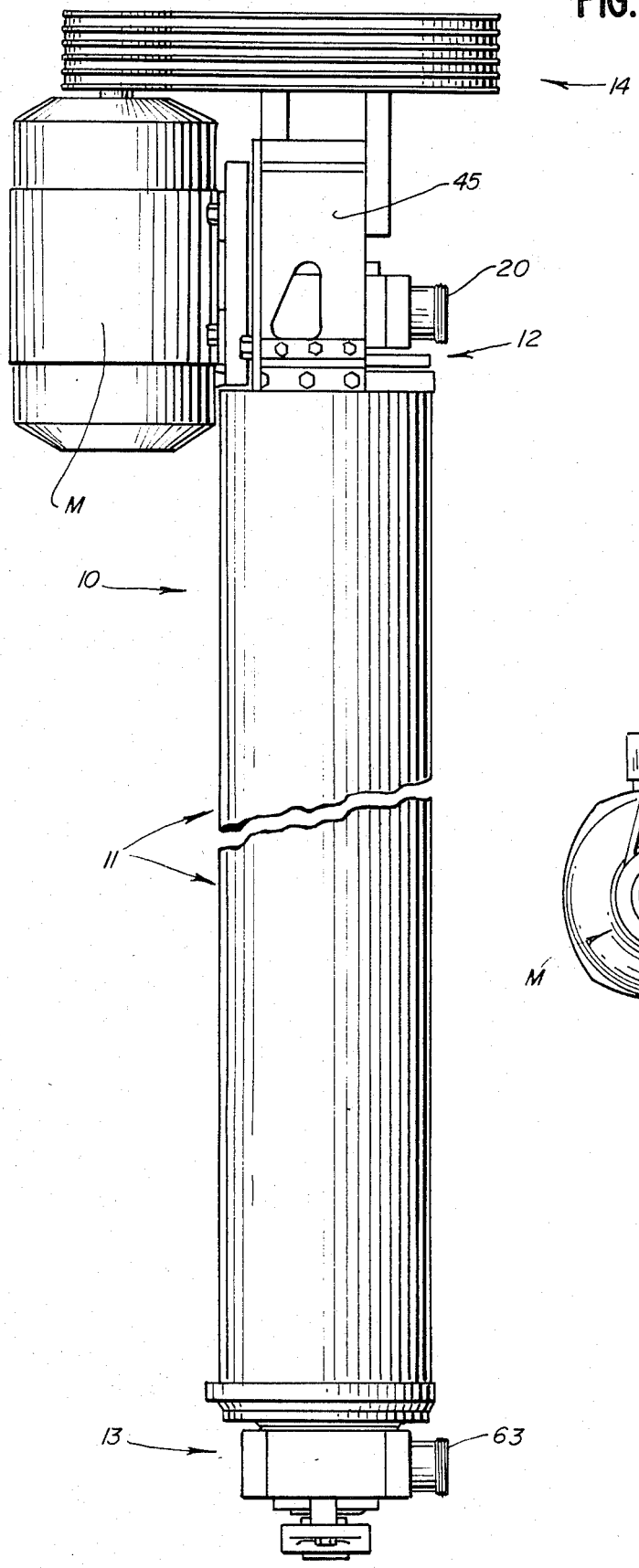
FIG. 1 is a fragmentary side elevational view of one form of the improved heat exchanger.
Figure 2:
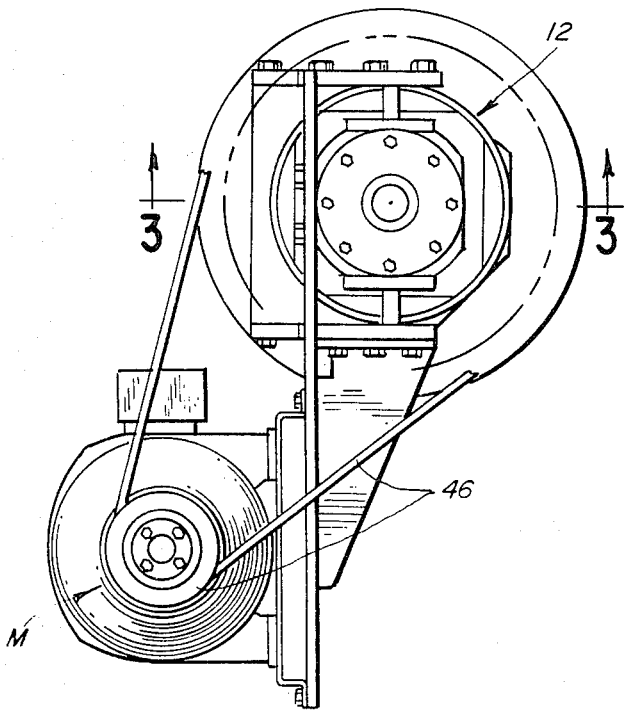
FIG. 2 is a top plan view of the heat exchanger of FIG. 1.

Referring now to the drawings and more particularly to FIGS. 1 and 2, one embodiment of an improved vertically extending heat exchanger 10 is shown which is of a type suitable for use in a food processing plant operation or the like wherein an aseptic system is being utilized. The exchanger 10 includes an upright chamber 11, endwall assemblies 12, 13 mounted, respectively, on the upper and lower end portions of the chamber; and a drive unit 14 mounted on the upper end portion of the chamber. Mounted within a cylindrical sleeve 15 formed within the chamber is an elongated dasher 16, see FIG. 3. The exterior of the dasher 16 coacts with the interior surface of sleeve 15 to form a product flow passage P.

The sleeve 15 is of suitable thermal conductive material and has the exterior surface thereof forming one wall of a passage H through which a liquid heat exchange medium is caused to flow by means of a pump or the like, not shown. As a general rule, the direction of the product flow in passage P is counter to the direction of the heat exchange medium flow in passage H. The flow directions in the passages P and H are shown by arrows $A_1$ and $A_2$. The outer wall of passage H is formed by an insulated casing 17.

The upper and lower endwall assemblies, 12, 13, are secured to the end portions of the chamber by suitable fasteners, not shown, which are well known in the art. The upper endwall assembly 12 includes a hollow cap-like member 18 provided with a product inlet 20 which communicates with an interior cavity 21. The cavity, in turn, communicates with the upper end of product flow passage P, see FIG. 3. Member 18 is provided with an opening 22 through which extends an elongated external shaft 23. The opening 22 is of sufficient size to allow a portion 24' of a static seal section 24 to extend therethrough as will be described more fully hereinafter. The exposed upper end of opening 22 is counter-bored forming a shoulder 25 against which a collar piece 26 rests, see FIG. 4. The piece 26 encompasses the portion 24' of static seal section which protrudes through opening 22. Carried on the upper side of collar piece 26 is a spring loaded, pivotally mounted latch L which is adapted to engage an exposed groove G formed at the upper end of portion 24'. The latch and groove coact to prevent rotation of portion 24' and to assure proper alignment between the collar piece 26 and the upper end of portion 24'. Such alignment is important because both the collar piece 26 and portion 24' are provided with inlet ports 27*a* and 28*a* and outlet ports 27*b* and 28*b* through which a liquid aseptic solution is caused to flow. Ports 27*a* and *b* and 28*a* and *b* communicate with various grooves and internal passages formed in portion 24' thereby assuring that the aseptic solution will circulate about portions of the exterior of shaft 23 and thus prevent contamination of the product flowing through cavity 21 and passage P.

Portion 24' of the static seal section carries an annular seal piece 30 which has a carefully machined end face 30', the latter being disposed perpendicular to the rotary axis of the dasher. Seal piece 30 is retained in a non-rotating position with respect to portion 24' by a pin 31 carried by piece 24' and extending into a complemental opening formed in piece 30, see FIG. 4.

A wear liner 32 encompasses the portion of the dasher shaft 23 which is disposed within the endwall assembly 12. The lower end of the liner 32 rests against an external shoulder 33 formed on the endface of the dasher and from which the shaft projects. The upper end of the liner engages a snap ring 34 carried within an external groove 35 formed in shaft 23. The upper end of the static seal section 24' is retained by a snap ring 70 carried within an external groove 32*a* formed in liner 32. The lower end of static seal section 24 rests against an external shoulder 32*b* on liner 32. The liner 32 is caused to rotate with the shaft by reason of a key K disposed within complemental keyways formed in shaft 23 and liner 32. A suitable O-ring seal 36 is disposed within an external groove 37 formed in shaft 23 and is in sealing engagement with liner 32, thereby preventing axial leakage of the aseptic solution past the seal.

An expansion seal 38 or the like is provided between the upper end of portion 24' and the upper exterior of liner 32. Conventional O-ring seals 40 are provided between portion 24' and liner 32; between portion 24' and piece 30; and between portion 24' and collar piece 26 and thus prevent leakage of the aseptic solution to the exterior of the endwall assembly and prevent intermixing of the aseptic solution and the product.

Figure 3:
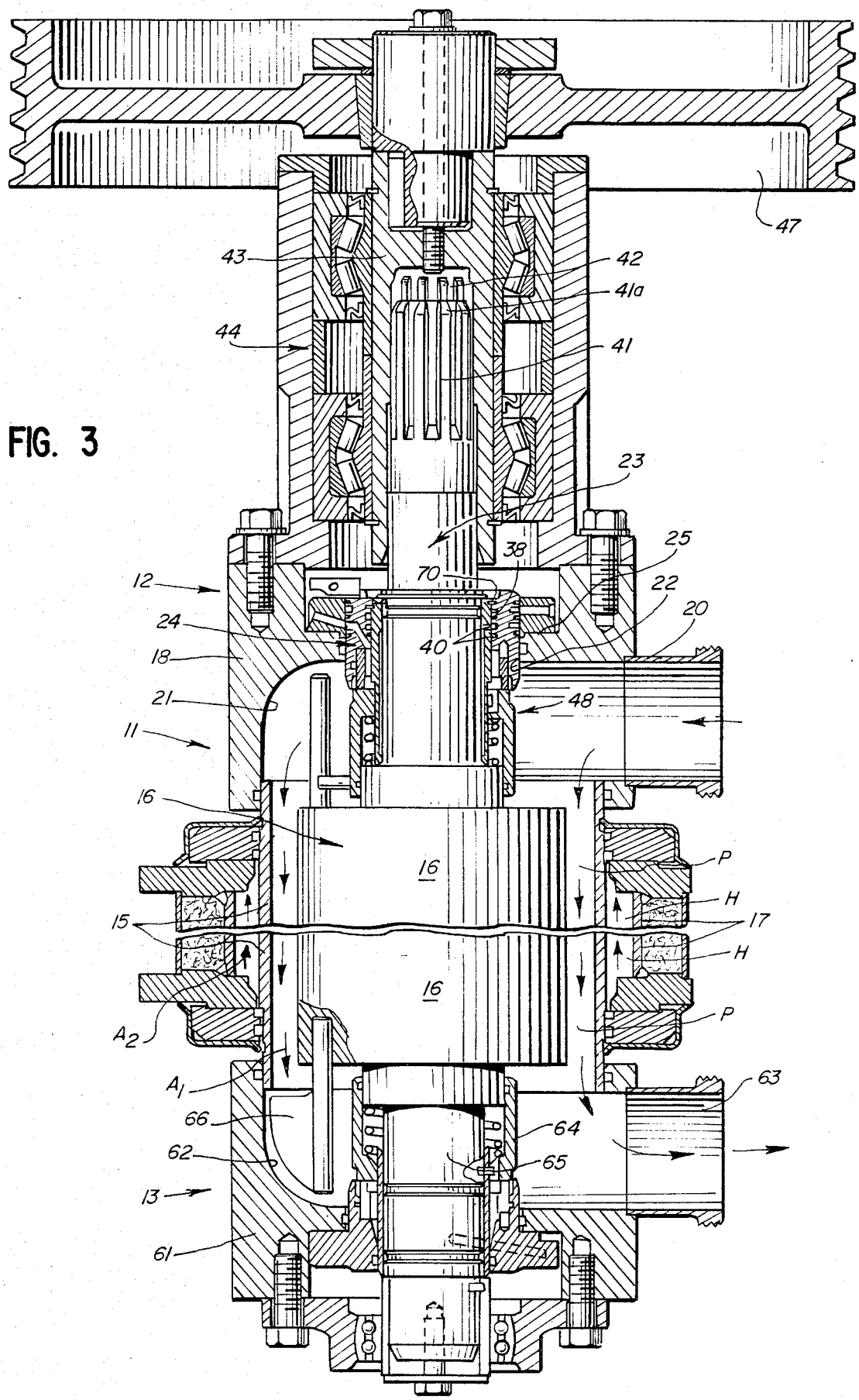
FIG. 3 is an enlarged fragmentary sectional view taken along line 3—3 of FIG. 2.

As observed in FIG. 3, the distal end of shaft 23 projects a substantial distance beyond member 18 and is provided with external splines 41 which are adapted to intermesh with internal splines 42 formed on a driveshaft 43, the latter comprising a component of the drive unit 14. It should be noted in FIG. 3 that the leading or free ends 41*a* of the external splines 41 are either tapered or rounded. The lower or free ends of the internal splines 42 are similarly shaped so that when the dasher 16 is moved longitudinally relative the chamber sleeve 15 into an operative mode, as seen in FIG. 3, the tapered or rounded ends of the external and internal splines will cause the splines 41 to be cammed into proper alignment between splines 42 and automatically intermeshed therewith.

Drive shaft 43 is supported by a suitable bearing 44 which in turn is supported in an elevated axially aligned position with respect to upper endwall assembly by a bracket 45, see FIG. 1. In the illustrated embodiment the driving unit 14 includes either an electric or hydraulic motor M; a belt and pulley combination 46, the pulley being keyed to an exposed end of the motor shaft; and an enlarged pulley 47 which is affixed to the upper end of driveshaft 43. The ratio of diameters of the pulley connected to the motor shaft and the pulley connected to the drive shaft may be varied as desired.

Besides the static seal section 24, the upper endwall section 12 includes a dynamic seal section 48 which is adapted to rotate as a unit with the dasher shaft 23 and to move as a unit with the shaft in an axial or longitudinal direction when the dasher 16 is moving between operative and inoperative modes, as will be described more fully hereinafter. Dynamic seal section 48 includes an annular seal piece 50 having a carefully machined endface 50' which is substantially perpendicular to the rotary axis of the dasher. Endface 50' assumes an abutting, sliding, sealing engagement with surface 30' of the stationary seal piece 30 when the dasher 16 is disposed in the operative mode—that is to say, the dasher 16 is fully assembled in the chamber 11 and the splines 41,42 are in intermeshing relation, as shown in FIG. 3. The seal piece 50 encompasses a lower portion of the wear sleeve 32 and is provided with a bayonet-type slot 51 which is adapted to interlockingly receive a radially extending pin 52 projecting from the exterior of the sleeve 32. The abutting sealing engagement between seal pieces 30 and 50 is maintained by a coil spring 53 and is disposed within a cavity C which encompasses the lower portion of wear sleeve 32. One end of spring 53 rests against the shaft shoulder 33 and the opposite end resiliently engages an internal shoulder 54 formed in seal piece 50. The lower end portion of seal piece 50 encompasses the peripheral of shoulder 33. An interior groove 55 is provided in the lower portion of seal piece 50 which accommodates an O-ring seal 56. The seal 56 prevents leakage of the product into cavity C or the aseptic solution into the cavity 21 of the hollow caplike member 18.

Figure 4:
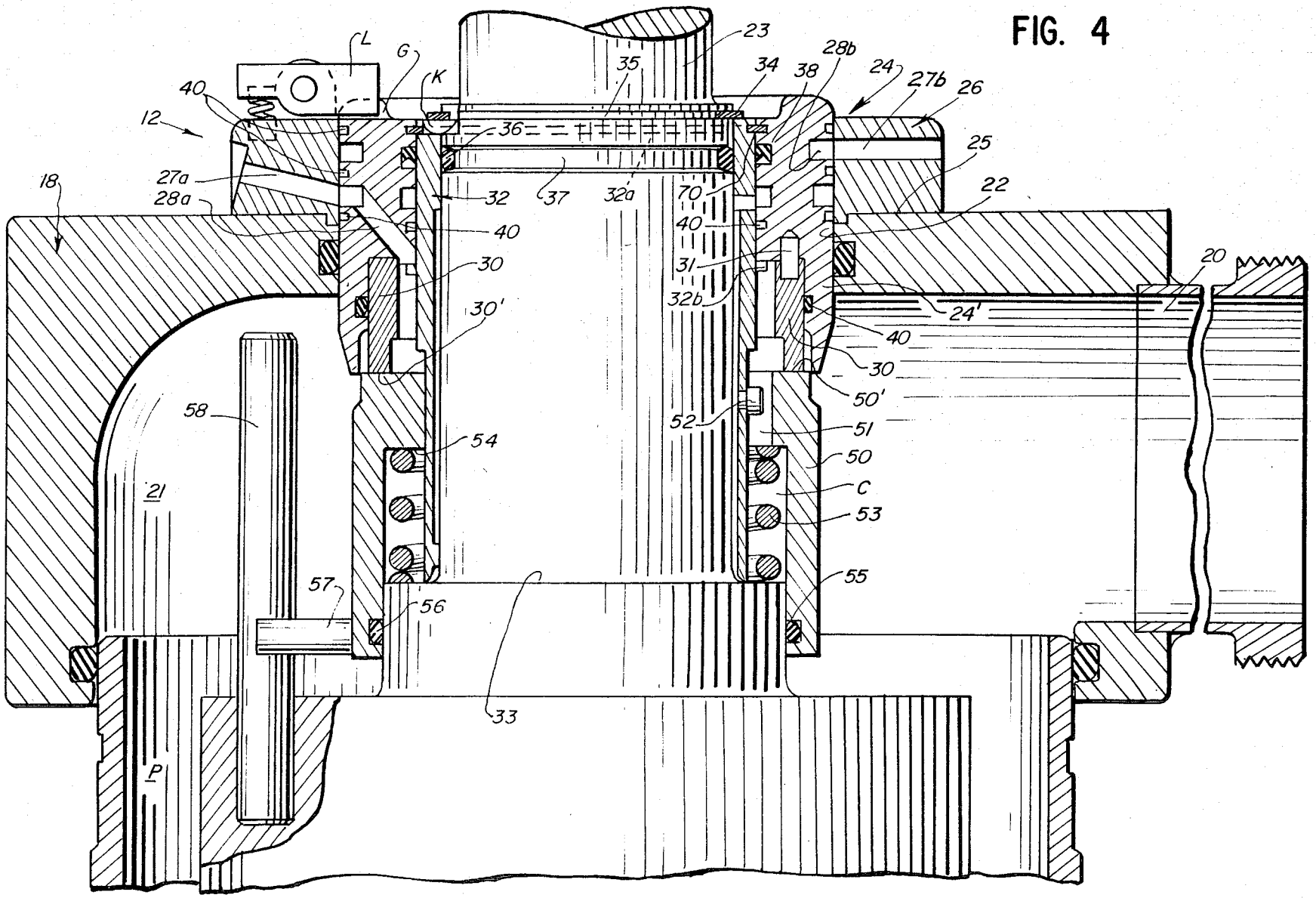
FIG. 4 is an enlarged fragmentary vertical sectional view of the upper end portion of the chamber and the endwall assembly mounted thereon.

As will be noted in FIG. 4, the lower end of seal piece 50 is provided an external finger 57 which projects radially outwardly and is moved by an elongated mixing rod 58. The finger 57, as seen in FIG. 4, is radially opposite seal 56 so as to form a fulcrum allowing the abutting sealing surfaces 30', 50' of seal pieces 30, 50 to be in proper sealing engagement when the dasher is in the operative mode. The rod extends longitudinally from the upper endface of the dasher into the cavity 21 formed in member 18. When the dasher rotates, the rod moves therewith and effects mixing of the product which has accumulated in cavity 21. Thus, by reason of the rod 58 and finger 57, as well as the pin 52 and slot 51, the sleeve 32 and seal piece 50 will rotate as a unit with dasher 16.

The lower endwall assembly 13 is removably secured to the lower end portion of chamber 11 by conventional fasteners, thereby facilitating simultaneously lowering of the assembly 13 and the dasher 16 and associated components with respect to the chamber 11. Lowering of the dasher and associated components to an inoperative mode is periodically necessary in order to service or check the abutting surfaces of the seal pieces 30,50 and the various O-ring and expansion seals 40,38. Accordingly, it is necessary that the lower end portion of the chamber be elevated to such an extent that the dasher and associated components can be lowered a sufficient amount to enable same to be entirely removed from the chamber or at least lowered enough so that the aforementioned seals and seal pieces can be inspected and replaced if necessary. The lowering and raising of the dasher and components can be accomplished by a conventional hydraulically actuated elevating mechanism, not shown, which is located adjacent the assembly 13. Because the portion 24' of the static seal section 24, the seal piece 30, the dynamic seal section 50, the wear sleeve 32, and the snap-ring 34 all move longitudinally as a unit with dasher 16, it is not necessary that any manual loosening or removal of parts of the exchanger located at the upper end portion of the chamber be undertaken in order to effect lowering of the dasher and associated components. The aforesaid lowering or raising operation is not impeded in any way by the intermeshing splines 41,42. As aforementioned, the rounded or tapered ends of the splines effect automatic camming of the splines 41 resulting in proper intermeshing thereof, thus, greatly facilitating moving of the dasher into the operative mode without necessitating manual guiding of the dasher from either the top or bottom of the chamber. Normally, when the exchanger is a scraped surface type, the exterior of the dasher will carry a plurality of symmetrically arranged scraper blades, not shown, which slidably engage the interior surface of the cylindrical sleeve 15 and prevent the buildup of product ice crystals on the surface when the dasher is rotating and the temperature of the surface is such as to cause such ice crystals to normally form.

The lower endwall assembly 13 includes a caplike member 61 which is provided with an interior cavity 62 into which the product flows from passage P. An outlet port 63 is formed in member 61 through which the product is discharged. Centrally disposed within member 61 and aligned with the rotary axis of the dasher 16 is a conventional thrust bearing 64 which accommodates a stub shaft 65 projecting axially downwardly from the lower endface of the dasher. Appropriate seals are provided between the bearing and shaft to prevent leakage outwardly of the product disposed within cavity 62. A paddle-like rod 66 extends from the lower endface of the dasher into cavity 62 and rotates therewith, thereby preventing the product from becoming quiescent and entrapped within the cavity.

The configuration and size of the various components heretofore described may be varied from that illustrated and will depend upon the type and density of the product being treated and whether it is to be cooled or heated. Furthermore, the type of heat exchange medium may vary (e.g., gas, liquid, electrical heating) according to the operation to be performed. While the apparatus has been described for use with a dairy product or the like, where contaminaton thereof is an important consideration, it is to be understood, of course, that the invention is not to be limited thereto as other types of products may flow through the improved exchanger.

In any variation of the improved apparatus, the ease of longitudinally moving the dasher and associated components between operative and inoperative modes without manually adjusting or removing parts from the upper end portion of the apparatus is an important feature common to all.

I claim:

1. A vertically extending heat exchanger comprising an upright chamber fixedly supported to assume a predetermined elevated position, said chamber having the interior thereof provided with a stationary inner sleeve of thermal conductive material, the exterior of said sleeve being encompassed by a heat exchange means; an elongated dasher mounted within said sleeve for selective relative longitudinal vertical movement between operative and inoperative modes; when in an operative mode, said dasher being assembled within said sleeve and being adapted to be rotated about a central longitudinal axis of said sleeve and coacting with the latter to provide a product flow passage defined by an exterior portion of said dasher and an interior surface portion of said sleeve; an elevated first endwall assembly removably mounted on a lower exterior end portion of said chamber, said assembly being provided with dasher bearing means; a second endwall assembly elevated in relation to said first endwall assembly and mounted on an upper exterior end portion of said chamber, said second endwall assembly including a removable static seal section in encompassing non-rotating relation with an upwardly projecting axial segment of said dasher, and dynamic seal section in encompassing relation with said axial segment and rotatable therewith as a unit, said static and dynamic seal sections having portions thereof in sealing engagement, both of said seal sections being movable endwise as a unit with the dasher relative to said second endwall assembly when said dasher is longitudinally moved between said operative and inoperative modes, unitary longitudinal movement of said seal sections and said dasher occurring without any manual adjustment of said second endwall assembly and while the latter remains mounted on the chamber upper exterior end portion; product inlet and outlet ports communicating with said product flow passage; and drive means elevated relative to said first endwall assembly and fixedly mounted adjacent the second endwall assembly and being provided with a drive segment operatively connected to the dasher axial segment for imparting rotational movement to said dasher when the latter is in said operative mode.

2. The heat exchanger of claim 1 wherein the upwardly projecting axial segment of the dasher comprises a shaft protruding from the second endwall assembly, the protruding portion of the shaft and the drive segment of the drive means being provided with complemental portions which drivingly engage one another when said dasher is in the operative mode.

3. The heat exchanger of claim 2 wherein the dynamic seal section includes a tubular seal piece in encompassing relation with the shaft and rotatable therewith, and said static seal section includes a tubular seal piece in encompassing non-rotating relation with said shaft, said seal pieces being axially aligned and in sliding, abutting, sealing engagement and disposed within an interior cavity formed within said second endwall assembly when said dasher is in said operative mode.

4. The heat exchanger of claim 3 wherein the seal pieces of said dynamic and static seal sections are preassembled on the dasher shaft prior to said dasher being disposed within the inner sleeve of said chamber.

5. The heat exchanger of claim 1 wherein, when the dasher is in the operative mode, the second endwall assembly and the static and dynamic seal sections thereof coact with the dasher axial segment to form a flow passage for an aseptic medium, the latter flow passage being segregated from said product flow passage.

6. The heat exchanger of claim 2 wherein the complemental portions of said shaft protruding portion and said drive segment are provided with complemental splines having free ends thereof cam shaped whereby, when said dasher is being relatively moved longitudinally upwardly into an operative mode, the complemental splines will be slidably cammed into intermeshing relation with one another.

7. The heat exchanger of claim 3 wherein the tubular seal piece of the dynamic seal section includes an internal seal means disposed in proximity to an end of said seal piece adjacent an end face of said dasher and in sealing engagement with the dasher shaft projecting from said end face, and a radially extending external finger means disposed in substantial radial alignment with said internal seal means and in contact with a protuberance on said end face whereby said tubular seal piece and said dasher rotate as a unit when said dasher is in an operative mode and the tubular seal pieces of said static and dynamic seal sections remain in abutting sliding predetermined axial alignment with each other.

8. A vertically extending heat exchanger comprising an upright chamber fixedly supported to assume a predetermined elevated position, said chamber having the interior thereof provided with a stationary inner sleeve of thermal conductive material, the exterior of said sleeve being encompassed by a heat exchanger means; an elongated dasher mounted within said sleeve for selective longitudinal relative movement between operative and inoperative modes; when in an operative mode, said dasher being assembled within said sleeve and being adapted to be rotated about a central longitudinal axis of said sleeve and coacting with the latter to provide a product flow passage defined by an exterior portion of said dasher and an interior surface portion of said sleeve; a first endwall assembly removably mounted on a lower exterior end portion of said chamber, said assembly being provided with dasher bearing means; a second endwall assembly mounted on the upper exterior end portion of said chamber, said second endwall assembly including a static seal section in encompassing non-rotating relation with an upwardly projecting axial segment of said dasher, and a dynamic seal section in encompassing relation with said axial segment and rotatable therewith as a unit, said static and dynamic seal sections having portions thereof in sealing engagement, both seal sections being movable endwise as a unit with the dasher when the latter is longitudinally moved between said operative and inoperative modes; product inlet and outlet ports communicating with said product flow passage; and drive means mounted adjacent the second endwall assembly and being provided with a drive segment for imparting rotational movement to said dasher when the latter is in said operative mode; the second endwall assembly and the static and dynamic seal sections thereof coact with the axial segment of the dasher, when the latter is in the operative mode, to form a flow passage for an aseptic medium which is segregated from the product flow passage; said second endwall assembly including a caplike member connected to the upper end portion of the chamber and overlying the upper end of the inner sleeve, a collar member mounted on said caplike member and aligned with an opening formed therein, the static seal section having a portion thereof sealingly embraced by said collar member, when the dasher is in the operative mode, and lock means adjustably mounted on said collar member and adapted to interlockingly engage the embraced static seal section and maintain the latter in a non-rotating relationship with respect to the dynamic seal section.

9. The heat exchanger of claim 8 wherein the collar member and the static seal section portion embraced thereby are provided with communicating ports through which an aseptic medium is adapted to flow and simultaneously be segregated from the product flow.

10. A vertically extending heat exchanger comprising an upright chamber fixedly supported to assume a predetermined elevation, said chamber including an interior sleeve of thermal conductive material encompassed by a heat exchange means; an elongated dasher rotatably mounted within said sleeve and being selectively adjustable longitudinally between operative and inoperative modes, when in said operative mode, said dasher having an exterior portion thereof coacting with an interior surface of said sleeve to form a product flow passage; a first endwall assembly removably mounted on a lower end portion of said chamber and being provided with dasher bearing means; a second endwall assembly elevated relative to said first endwall assembly and mounted on an upper end portion of said chamber, said second endwall assembly being provided with an interior cavity in which is disposed a non-rotating static seal section and a dynamic seal section, said seal sections being in encompassing relation with an upwardly projecting axial segment of the dasher and said dynamic seal section being rotatable as a unit with said dasher, said seal sections being in continuous sealing engagement when said dasher is in either mode and movable longitudinally with said dasher when the latter moves relative to said chamber between said modes; product inlet and outlet ports communicating with said product flow passage; and drive means elevated relative to said first endwall assembly and fixedly mounted adjacent said second endwall assembly and being provided with a drive segment drivingly engaging a portion of the dasher axial segment when said dasher is in the operative mode; movement of said dasher to and from said operative mode being effected while the second endwall assembly remains in place on the upper end portion of the chamber and without the need for any manual adjustment of any component of said second endwall assembly.

* * * * *